US009306304B2

(12) United States Patent
Chen et al.

(10) Patent No.: US 9,306,304 B2
(45) Date of Patent: Apr. 5, 2016

(54) SHIELDED FLAT FLEXIBLE CABLE CONNECTOR WITH GROUNDING

(71) Applicants: Chung-Hao J. Chen, Portland, OR (US); Xiang Li, Portland, OR (US)

(72) Inventors: Chung-Hao J. Chen, Portland, OR (US); Xiang Li, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 5 days.

(21) Appl. No.: 14/302,954

(22) Filed: Jun. 12, 2014

(65) Prior Publication Data

US 2015/0364846 A1 Dec. 17, 2015

(51) Int. Cl.

| | |
|---|---|
| ***H01R 3/00*** | (2006.01) |
| ***H01R 12/77*** | (2011.01) |
| ***H01R 13/629*** | (2006.01) |

(52) U.S. Cl.

CPC ..... *H01R 12/775* (2013.01); *H01R 13/62994* (2013.01)

(58) Field of Classification Search

CPC ..... H01R 12/72; H01R 12/77; H01R 12/771; H01R 12/772; H01R 12/775; H01R 12/79; H01R 12/82; H01R 12/85; H01R 12/86

USPC ..... 439/497, 492–495, 499

See application file for complete search history.

(56) References Cited

U.S. PATENT DOCUMENTS

| | | | | |
|---|---|---|---|---|
| 4,341,430 | A * | 7/1982 | Crawford | 439/409 |
| 4,426,125 | A * | 1/1984 | Crawford | 439/404 |
| 4,641,904 | A * | 2/1987 | Kosugi et al. | 439/404 |
| 6,004,156 | A * | 12/1999 | Roque et al. | 439/495 |
| 7,695,295 | B2 * | 4/2010 | Hanyu | 439/153 |

* cited by examiner

*Primary Examiner* — Vanessa Girardi

(74) *Attorney, Agent, or Firm* — Jordan IP Law, LLC

(57) ABSTRACT

Methods and apparatuses may provide for a grounding between a shield on a flat flexible cable and a printed circuit board. According to one embodiment, the pins of a connector include ground pins that contact both ground traces on the flat flexible cable and a shield on the flat flexible cable, further connecting the cable to a ground plane.

19 Claims, 9 Drawing Sheets

SHIELDED FLAT FLEXIBLE CABLE CONNECTOR WITH GROUNDING

BACKGROUND

A flat flexible cable (FFC) may typically be used as a bridge between motherboard and daughter boards in computing systems including desktops, notebooks, tablets and smartphones. Such cables may be more economical than other cables such as flexible printed circuits and micro-coaxial cables. Absent ground shielding, unshielded FFC cables may have poor impedance match, high insertion loss and high noise radiation. This makes unshielded cables poorly suited for transmitting high speed signals. Universal Serial Bus (USB) 3.0 standard serial ports, for example, may run at speeds in excess of 5 gigabits per second. Equipment manufacturers may instead use more expensive cabling options such as micro-coaxial cables, which increases unit cost.

An FFC cable may have a thin metal sheet attached over a substantial portion of its length to act as an electromagnetic (EM) shield. This improves the cable signal integrity because the wire characteristic impedance may be controlled through the shield. However, if the shield is not properly grounded it is a floating shield, and a floating shield may radiate noise significantly and cause radio frequency interference (RFI) and electromagnetic interference (EMI).

BRIEF DESCRIPTION OF THE DRAWINGS

The various advantages of the embodiments will become apparent to one skilled in the art by reading the following specification and appended claims, and by referencing the following drawings, in which:

DESCRIPTION OF EMBODIMENTS

Figure 1A:
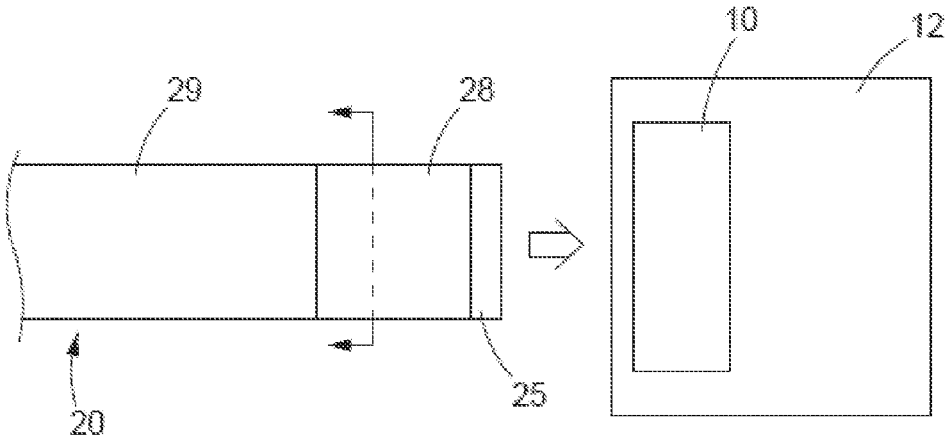
FIGS. 1A and 1B are top and bottom views, respectively, of an example of an FFC cable and a printed circuit board-mounted connector according to an embodiment.
Figure 1B:
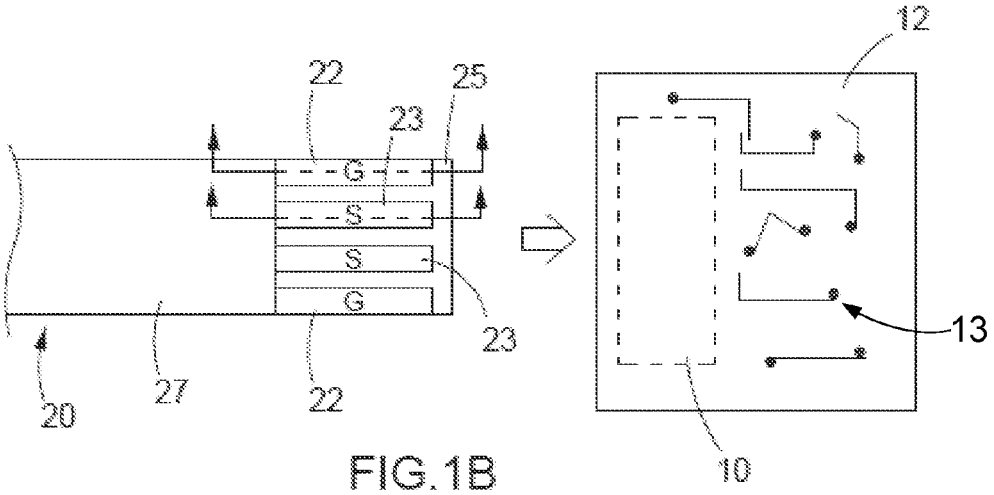
Figure 2:
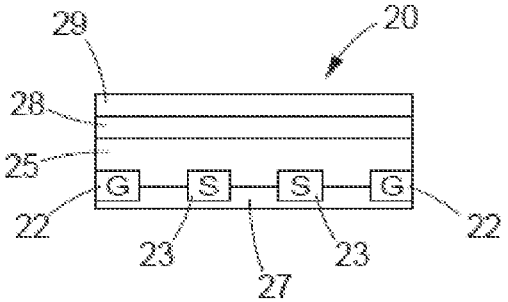
FIG. 2 is front view of an end of an example of an FFC cable according to an embodiment.

One way of providing shielding against EMI is to surround the signal lines with a ground line, as is done in a coaxial cable. Such an approach may, however, be expensive to implement where there are multiple parallel lines such as in an FFC, and it may take up substantial space. One less expensive approach to shielding is illustrated in FIGS. 1A, 1B, and FIG. 2. FIG. 1A is a top plan view showing a connector 10 mounted to a printed circuit board (PCB) 12 and an FFC 20 with which it is configured to mate. In the illustrated embodiment, the PCB 12 may include an antenna 13. The FFC may be of layered construction. For example, a substrate 25, which may be made of an insulating dielectric material, bears a series of parallel electrically conductive traces 22 and 23 made of an electrically conductive material such as copper. In the illustrated embodiment (FIG. 1B and FIG. 2), some traces may be dedicated for use as ground line traces 22 whereas others may be dedicated for use as signal line traces 23. Overlying the substrate 25 is a shield 28, which may be made of a relatively thin layer of conductive material such as copper. This layer is thin so as to permit the cable to be flexible. Overlying the shield is an insulator layer 29 and underlying the traces is an insulating layer 27. As can be seen in FIGS. 1A and 1B, the insulating layers 27 and 29 do not extend over the full length of the FFC, but terminate short of the end of the FFC so as to expose the ground line traces 22 and signal line traces 23 and the shield 28, thereby allowing electrical contact to be made with these elements in the connector, as will be explained further below.

Shield 28 helps to shield the surrounding system from stray electromagnetic interference (EMI) arising from the FFC 20, as well to shield the FFC 20 from picking up EMI from the surrounding systems. In use, the FFC 20 may be inserted into a connector 10, which in the illustrated embodiment is a card edge connector mounted to a printed circuit board (PCB) 12. Grounding the FFC to the PCB via the embodiments set forth here enhances the efficacy of the shield and reduces interference.

Figure 3:
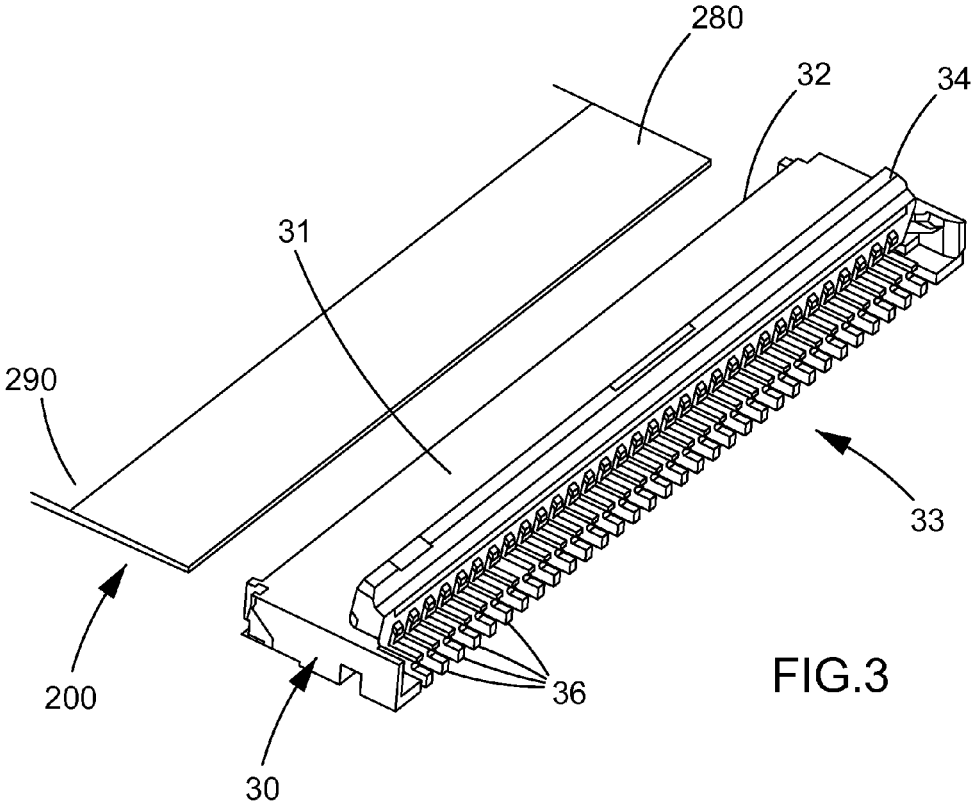
FIG. 3 is a perspective view showing an end of an example of an FFC cable and a connector according to an embodiment.

One example of such grounding is provided by the illustrated connector 30 in FIG. 3, which in the illustrated example is of the back latch type. It is shown in conjunction with an FFC 200. The FFC 200 may be of a layered construction similar to that of the FFC shown in FIG. 2, but including more traces. The connector 30 has a housing 31 having a front end 32 into which the exposed shield 280 of the FFC cable 200 is inserted from the left (as illustrated in FIG. 3). On the back side 33 of the connector 30 are seen a plurality of electrically conductive pins 36 which may be press-fitted inside the connector housing 31. The pins 36 provide electrical contacts linking the traces of the FFC to a PCB (not shown). In the illustrated embodiment, a rearward-facing pressure lever 34

(shown raised in FIG. 3) helps further secure the connection between these pins and the FFC 200 when it is depressed.

Figure 4:
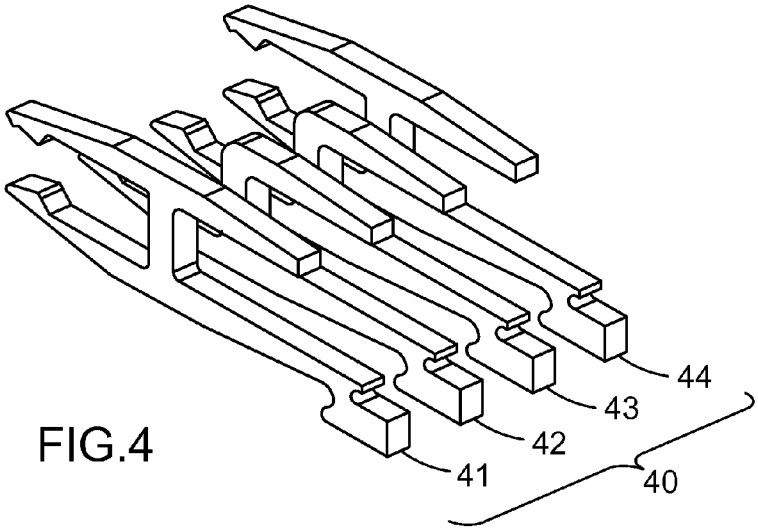
FIG. 4 is a perspective view of an example of a group of four pins that may be used in the connector of FIG. 3 according to an embodiment.
Figure 5:
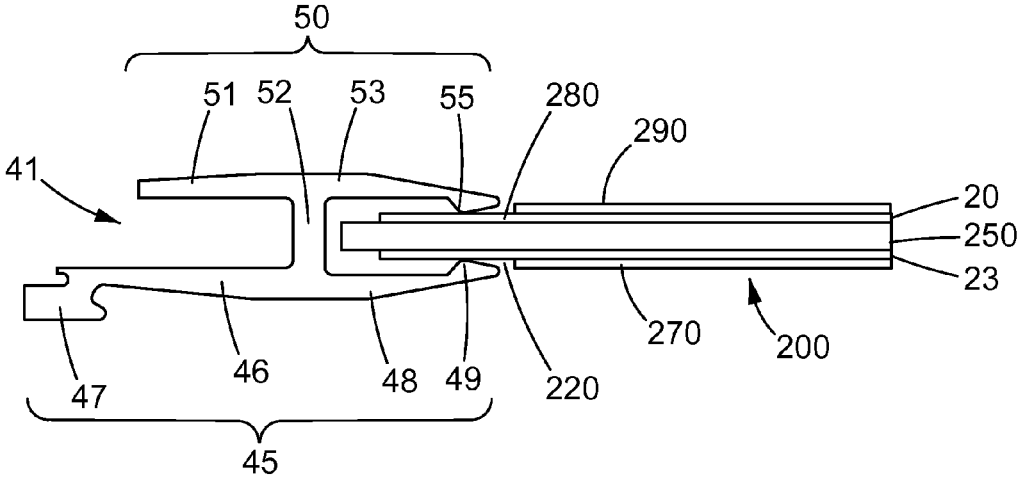
FIG. 5 is a sectional view of an example of a ground pin connected to a ground trace of an FFC according to an embodiment.
Figure 6:
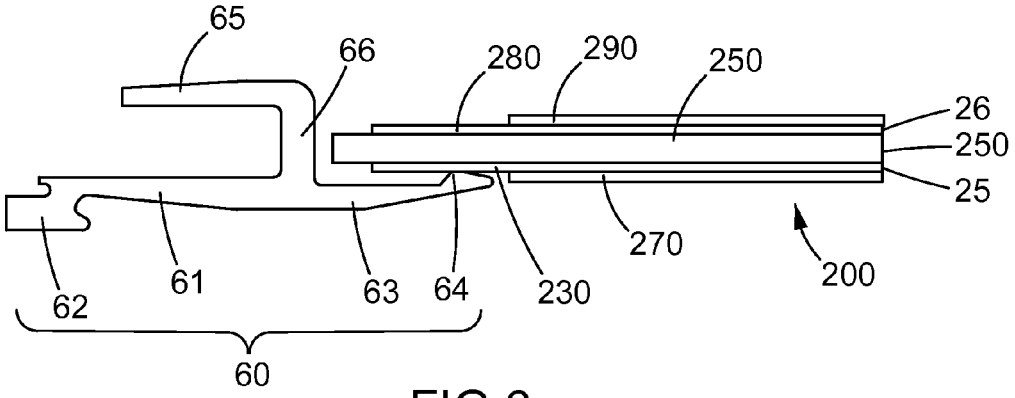
FIG. 6 is a sectional view of an example of a signal pin connected to a signal trace of an FFC according to an embodiment.

An example of structure by which the pins 36 provide for electrical contact is illustrated in FIGS. 4-6. Illustrated in FIG. 4 is an exemplary group 40 of four pins 41-44 in a "Ground-Signal-Signal-Ground", or "GSSG" configuration, which may be repeated along the full width of pins 36 as needed. In this configuration, two ground pins 41 and 44 bracket two signal pins 42 and 43, which are assigned to corresponding ground line traces and signal line traces on the FFC 200. The GSSG configuration is but one possible configuration that may be used in an FFC and connector, and is shown here for illustrative purposes. Other pin configurations having more or fewer ground pins or signal pins may be used, as well as configurations having different arrangements of a given number of signal and ground pins, depending on the particular design of the FFC employed.

FIG. 5 is a side sectional view showing the connection between a ground pin 41 and a corresponding ground line trace 220 and shield 280 of an FFC 200 that may be similar in cross-section to the FFC 20 shown in FIG. 2. The FFC 200 has an insulating layer 290 overlying a conductive shield 280 that lies atop a dielectric substrate 250. Along its underside are a series of ground line traces 220 and signal line traces 230, over which is an insulating layer 270. The terminal ends of the traces and the shield are exposed to facilitate electrical contact.

The ground pin 41 has a lower portion 45 that is centrally connected to an upper portion 50 via a central stem 52. The lower portion 45 has a terminal arm 46 that extends at one end to a terminal tail 47, which may be surface mounted to a PCB, and which oppositely provides a ground trace arm 48 terminating in a contact point 49. The upper portion 50 of the pin 41 has a retention arm 51 extending onward past the central stem 52 to provide a ground shield arm 53 that terminates in a contact point 55. The ground pin is made of an electrically conductive material, such as copper. As can be seen in FIG. 5, when the FFC 200 is fully inserted into the connector 30 there is registry of pin 41 and ground line trace 220 and the contact point 49 of the ground trace arm 48 makes electrical contact with the exposed portion of the ground line trace 220. Similarly, the contact point 55 of the ground shield arm 53 makes electrical contact with the exposed portion of the shield 280. The particular dimensions of the spacing between the contact points 55 and 49 may be selected to provide for a secure interference fit of the FFC within the ground pin 41.

FIG. 6 shows the connection between an exposed end of an illustrated signal line trace 230 and a signal pin 42, which is made of an electrically conductive material such as copper. The signal pin 42 has a lower portion 60 having a terminal arm 61 that extends at one end to a terminal tail 62, which may be surface mounted to a PCB, and at another end continues on as a signal trace arm 63 which terminates in a contact point 64. The upper portion of the signal pin 42 is in the form of a retention arm 65 that connects with the lower portion 60 via a stem 66. As can be seen in FIG. 6, when the FFC 200 is fully inserted into the connector 30 there is registry of the signal pin 42 with the signal line trace 230, and the contact point 64 of the signal trace arm 63 makes electrical contact with the exposed portion of the signal line trace 220. While the lower portion of this example signal pin 42 is similar in form to the lower portion of the ground pin 41, the signal pin 42 does not provide for electrical contact with the shield 280.

The ground pin 41 may be connected at its terminal tail 47 to the ground plane of a circuit board. Thus, the ground line trace 220 of the FFC is electrically connected to the shield 280 as well to a ground plane via the ground pin 41. This provides for EMI shielding of the system and the FFC.

Figure 7:
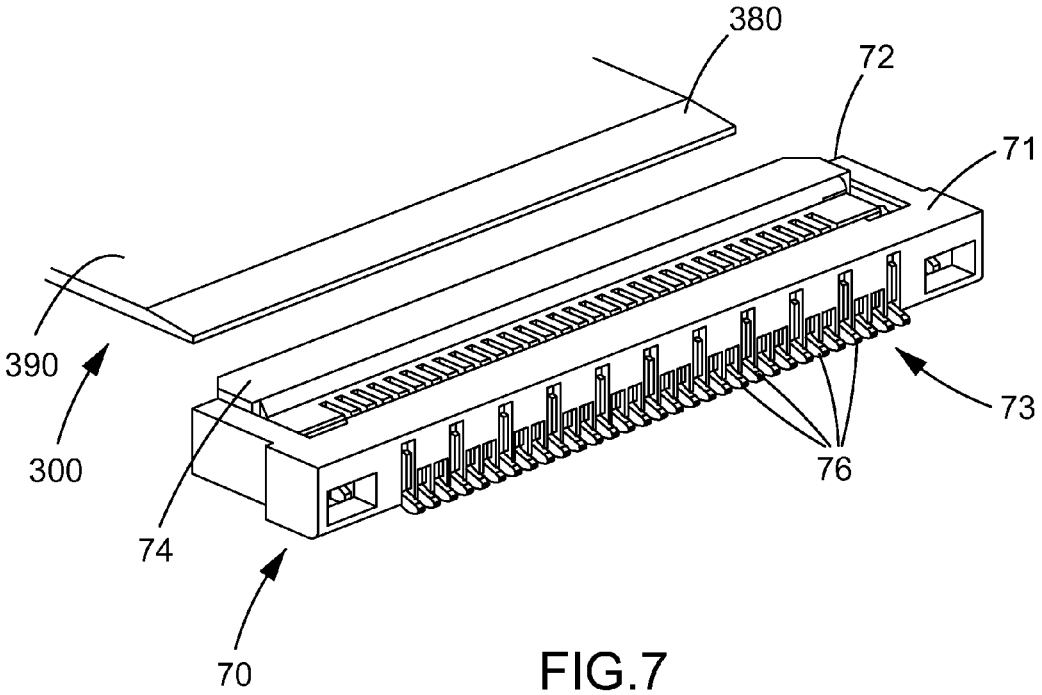
FIG. 7 is a perspective view showing an end of an example of an FFC cable and a connector according to an embodiment.

Another example of an embodiment of a grounded connector is provided by the illustrated connector 70, which in the illustrated example in FIG. 7 is of the front latch type. It is illustrated in conjunction with an FFC 300 in FIGS. 7 and 9-10. The FFC 300 may be of a layered construction similar to that of the FFC shown in FIG. 2, but including more traces. The connector 70 has a housing 71 having a front end 72 into which the exposed shield 380 of FFC cable 300 is inserted from the left (as illustrated in FIG. 7). The shield is made of an electrically conductive material, e.g. copper. On the back end 73 of the connector 70 are seen a plurality of pins 76 securely contained within the housing 71. The pins 76 provide electrical contacts linking the traces of the FFC 300 to a PCB (not shown). In the illustrated embodiment, a front-facing pressure lever 74 is further provided to secure the connection between these pins and the FFC 300 when it is depressed.

Figure 8:
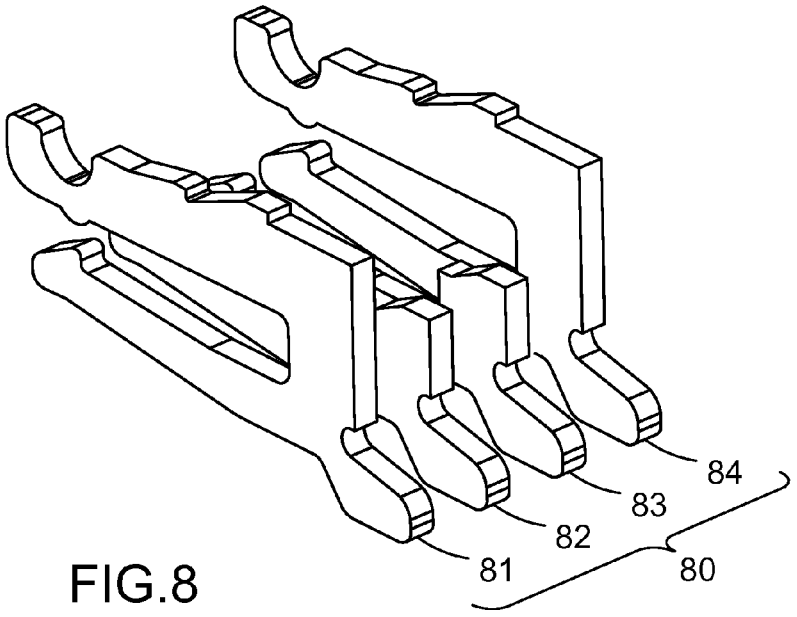
FIG. 8 is a perspective view of an example of a group of four pins that may be used in the connector of FIG. 7 according to an embodiment.
Figure 9:
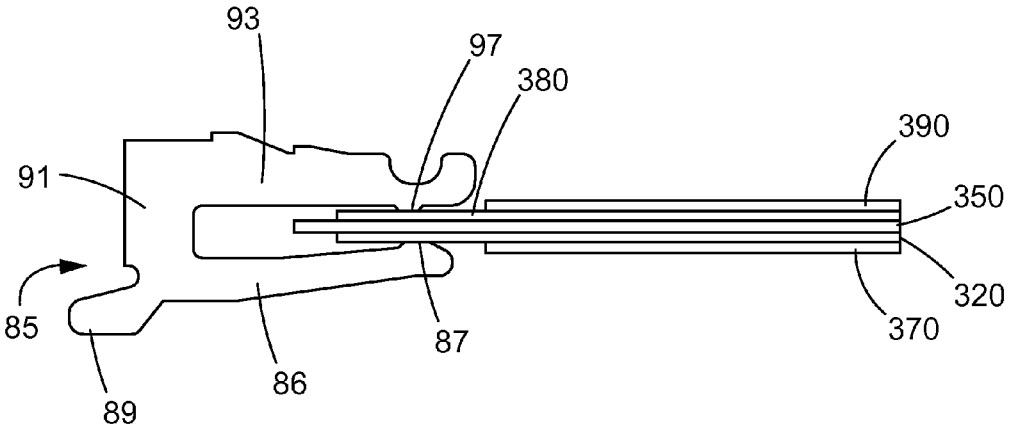
FIG. 9 is a sectional view of an example of the ground pin of FIG. 8 connected to a ground trace of an FFC according to an embodiment.
Figure 10:
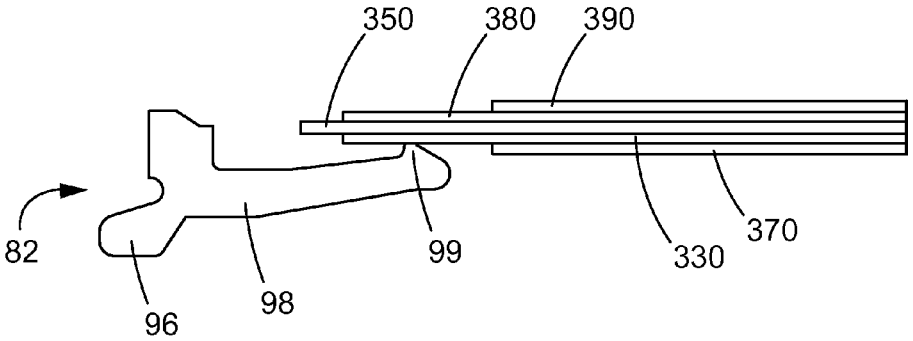
FIG. 10 is a sectional view of an example of the signal pin of FIG. 7 connected to a signal trace of an FFC according to an embodiment.

An example of structure by which the pins 76 provide for electrical contact is illustrated in FIGS. 8-10. Illustrated in FIG. 8 is an exemplary group 80 of four pins 81-84 in a "Ground-Signal-Signal-Ground," or "GSSG" configuration, which may be repeated along the full width of pins 76 as needed. In this configuration, two ground pins 81 and 84 bracket two signal pins 82 and 83, which are assigned to corresponding ground line traces and signal line traces on the FFC 300. The GSSG configuration is but one possible configuration that may be used in an FFC, and is shown here for illustrative purposes. Other pin configurations having more or fewer ground pins or signal pins may be used, as well as configurations having different arrangements of a given number of signal and ground pins, depending on the particular design of the FFC employed.

FIG. 9 is a side sectional view showing the connection between a ground pin 85 and a corresponding ground line trace 320 and shield 380 of the FFC 300, which may be similar in cross-section to the FFC 20 shown in FIG. 2. The FFC 300 has an insulating layer 390 overlying the electrically conductive shield 380 that lies atop a dielectric substrate 350. Along its underside are a series of ground line traces 320 and signal line traces 330, over which is an insulating layer 370. The terminal ends of the traces and the shield are exposed to facilitate electrical contact.

The ground pin 85 has ground line trace arm 86 that is connected to a ground shield arm 93 via a stem 91. The ground trace arm 86 extends at one end to a terminal tail 89, which may be surface mounted to a PCB, and on its opposite end terminates in a contact point 87. Similarly, the ground shield arm 93 terminates in a contact point 97. The ground pin 85 is made of an electrically conductive material, such as copper. As can be seen in FIG. 9, when the FFC 300 is fully inserted into the connector 70 there is registry of ground pin 85 and ground line trace 320, and the contact point 87 of the ground trace arm 86 makes electrical contact with the exposed portion of the ground line trace 320. Similarly, the contact point 97 of the ground shield arm 93 makes electrical contact with the exposed portion of the shield 380. The particular dimensions of the spacing between the contact points 97 and 99 may be selected to provide for a secure interference fit of the FFC within the ground pin 85.

FIG. 10 shows the connection between an exposed end of an illustrated signal line trace 330 and a signal pin 82, which is made of an electrically conductive material such as copper. The signal pin 82 has a lower signal trace arm 98 that extends at one end to a terminal tail 62, which may be surface mounted to a PCB, and at another end terminates with a contact point 99. As can be seen in FIG. 10, when the FFC 300 is fully inserted into the connector 70 there is registry of the signal pin 82 with the signal line trace 330, and the contact point 99 of the signal trace arm 98 makes electrical contact with the exposed portion of the signal line trace 330. In contrast to the ground pin 85, the signal pin 82 does not provide for electrical contact with the shield 380.

The ground pin 85 may be connected at its terminal tail 89 to the ground plane of a circuit board. Thus, the ground line trace 320 of the FFC is electrically connected to the shield 380 as well to a ground plane via the ground pin 85. This provides for EMI shielding of the system and the FFC.

Figure 11:
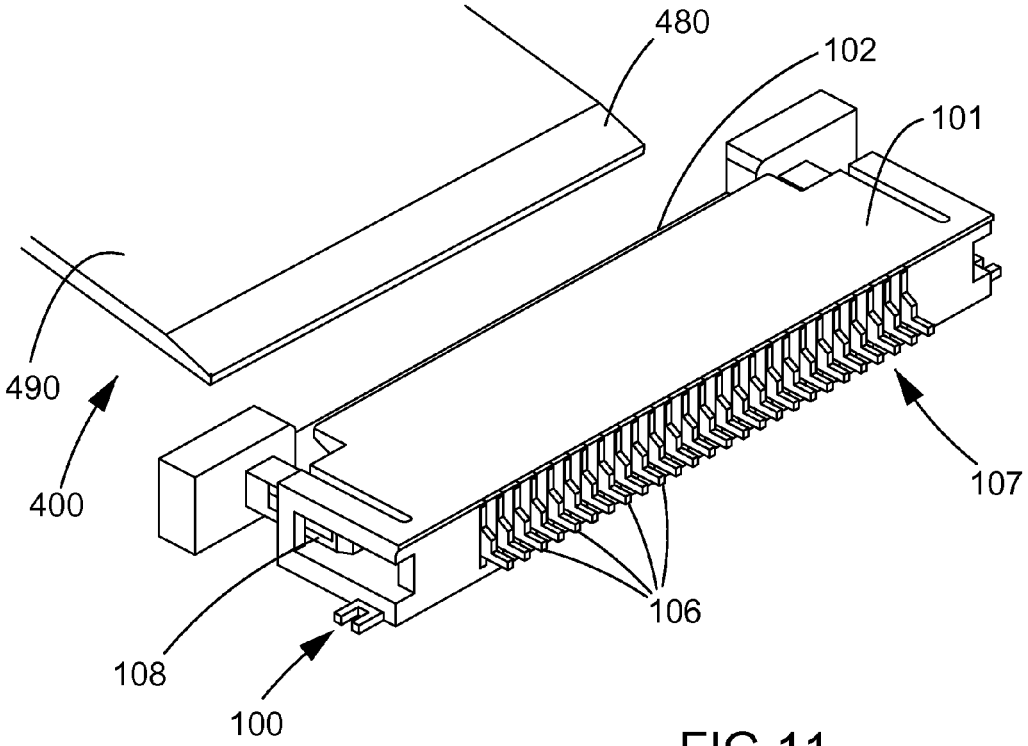
FIG. 11 is a perspective view of an example of a connector according to an embodiment.

Another example of an embodiment of a grounded connector is provided by the illustrated connector in FIG. 11, in which the connector 100 is of the side front latch type. It is illustrated in conjunction with a FFC 400 in FIG. 11 and FIGS. 13-14. The FFC 400 may be of a layered construction similar to that of the FFC shown in FIG. 2, but including more traces. The connector 100 has housing 101 having a front end 102 into which the exposed portion of shield 480 of FFC cable 400 is inserted from the left (as illustrated in FIG. 11). The shield is made of an electrically conductive material, such as copper. Seen on the back end 107 of the connector 100 are a plurality of pins 106 securely fitted into the housing 101. The pins 106 provide electrical contacts linking the traces of the FFC 400 to a PCB (not shown). In the illustrated embodiment, side latches such as 108 are further provided to secure the connection between these pins and the FFC 300.

Figure 12:
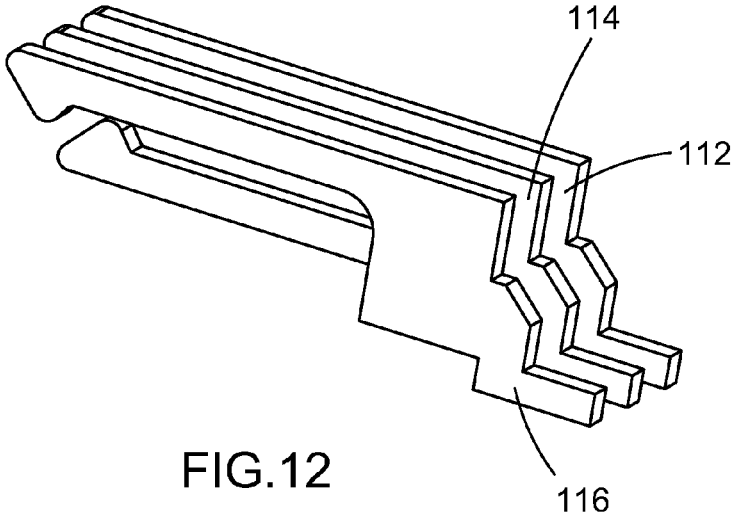
FIG. 12 is a perspective view of an example of a group of three pins that may be used in the connector of FIG. 11 according to an embodiment.
Figure 13:
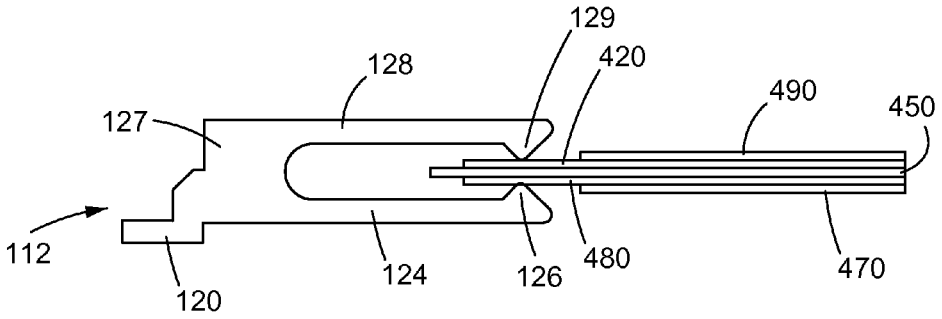
FIG. 13 is a sectional view of an example of a ground pin of FIG. 12 connected to a ground trace of an FFC according to an embodiment.
Figure 14:
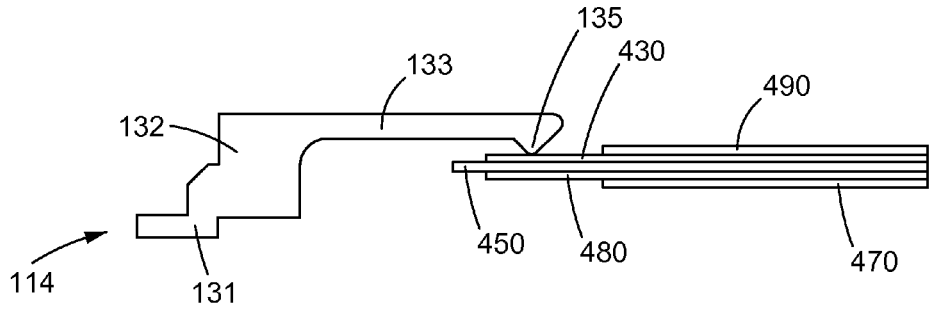
FIG. 14 is a sectional view of an example of the signal pin of FIG. 12 connected to a signal trace of an FFC according to an embodiment.

An example of structure by which the pins 106 provide for electrical contact is illustrated in FIGS. 12-14. Illustrated in FIG. 12 is an exemplary group of three pins 112, 114, and 116 in a "Ground-Signal-Signal", or "GSS" configuration, which may be repeated along the full width of pins 106 as needed. In this configuration, a ground pin 112 and two signal pins 114 and 116 are provided, and are assigned to corresponding ground line traces and signal line traces on the FFC 400. The GSS configuration is but one possible configuration that may be used in an FFC, and is shown here for illustrative purposes. Other pin configurations having more or fewer ground pins or signal pins may be used, as well as configurations having different arrangements of a given number of signal and ground pins, depending on the particular design of the FFC employed.

FIG. 13 is a side sectional view showing the connection between a ground pin 112 and a corresponding ground line trace 420 and shield 480 of the FFC 400, which may be similar in cross-section to the FFC 20 shown in FIG. 2. The FFC 400 has an insulating layer 470 underlying a conductive shield 480 that covers a dielectric substrate 450. Along its upper side are a series of ground line traces 420 and signal line traces 430, over which is an insulating layer 490. The terminal ends of the traces and the shield are exposed to facilitate electrical contact. The ground pin 112 has ground trace arm 128 that is connected to a ground shield arm 124 via a linking portion 127, which terminates at a terminal tail 120 that may be surface mounted to a PCB (not shown). The ground trace arm 128 terminates at a contact point 129. Similarly, the ground shield arm 124 terminates in a contact point 126. The ground pin 112 is made of an electrically conductive material, such as copper. As can be seen in FIG. 13, when the FFC 400 is fully inserted into the connector 100 there is registry of the ground pin 112 and ground line trace 420, and the contact point 129 of the ground trace arm 128 makes electrical contact with the exposed portion of the ground line trace 420. Similarly, the contact point 126 of the ground shield arm 124 makes electrical contact with the exposed portion of the shield 480. The particular dimensions of the spacing between the contact points 129 and 126 may be selected to provide for a secure interference fit of the FWC within the ground pin 112.

FIG. 14 shows the connection between an exposed end of an illustrated signal line trace 430 and a signal pin 114, which is made of an electrically conductive material such as copper. The signal pin 114 has an upper signal trace arm 133 that extends at one end via a portion 132 to a terminal tail 131, which may be surface mounted to a PCB (not shown), and at another end terminates at a contact point 135. As can be seen in FIG. 14, when the FFC 400 is fully inserted into the connector 100 there is registry of the signal pin 114 with the signal line trace 420, and the contact point 135 of the signal trace arm 133 makes electrical contact with the exposed portion of the signal line trace 420. In contrast to the ground pin 112, the signal pin 114 does not provide for electrical contact with the shield 480.

The ground pin 112 may be connected at its terminal tail 120 to the ground plane of a circuit board. Thus, the ground line trace 420 of the FFC may be electrically connected to the shield 480 as well to a ground plane via the ground pin 112. This provides for EMI shielding of the system and the FFC.

Figure 15:
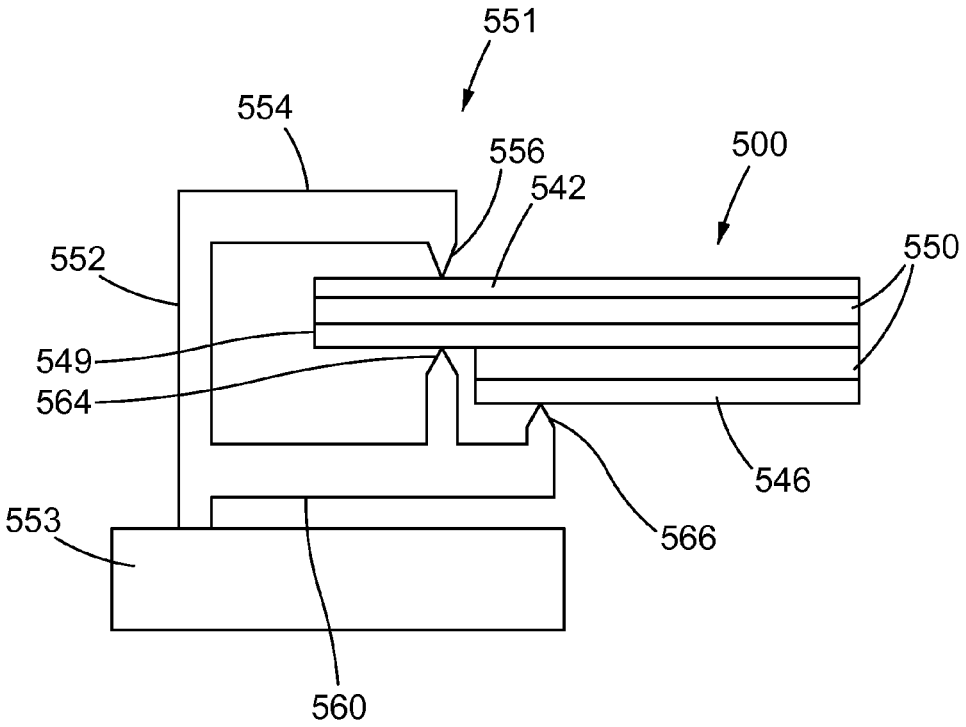
FIG. 15 is a schematic view of an example of a ground pin connected to a ground trace of an FFC having dual shields according to an embodiment.
Figure 16:
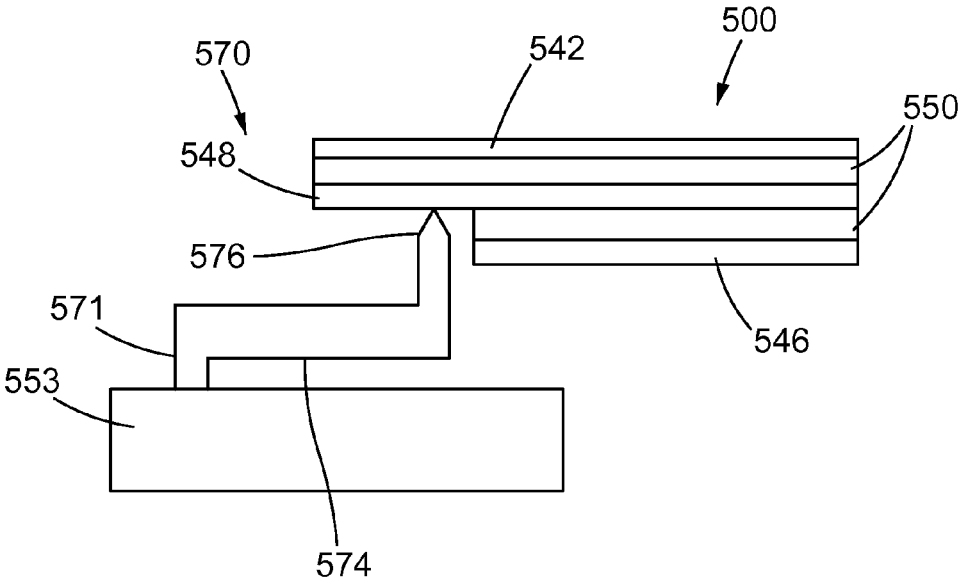
FIG. 16 is a schematic view of an example of a signal pin connected to a signal trace of an FFC having dual shields according to an embodiment.

FIGS. 15 and 16 schematically illustrate an example of an embodiment in which an FFC 500 is provided with both an upper shield 542 and a lower shield 546, each separated from signal line traces 548 and ground line traces 549 by an insulating layer 550. FIG. 15 illustrates a ground pin 551 that has a post 552 that is connected to a ground plane associated with a PCB 553. Emerging from the upper end of the post 552 is an upper ground shield arm 554 terminating in a contact point 556. Connected to the post 552 below the upper ground shield arm 554 is a lower arm 560 having projecting from it both a ground trace contact point 564 and a lower shield contact point 566.

FIG. 16 illustrates a signal pin 570 that has a post 571 that is connected to the PCB 553. Connected to the upper end of the post 571 is a signal trace arm 574 that terminates in a contact point 576.

When the FFC 500 is inserted into a connector utilizing the signal pin 570, the contact point 576 makes electrical contact with the signal line trace 548. Also, when the FFC 500 is inserted into a connector utilizing ground pin 551, three points of contact are provided for electrical connection to ground: one to the upper shield 542, one to the lower shield 546, and one to the ground trace 549. This arrangement provides an additional degree of shielding.

Figure 17:
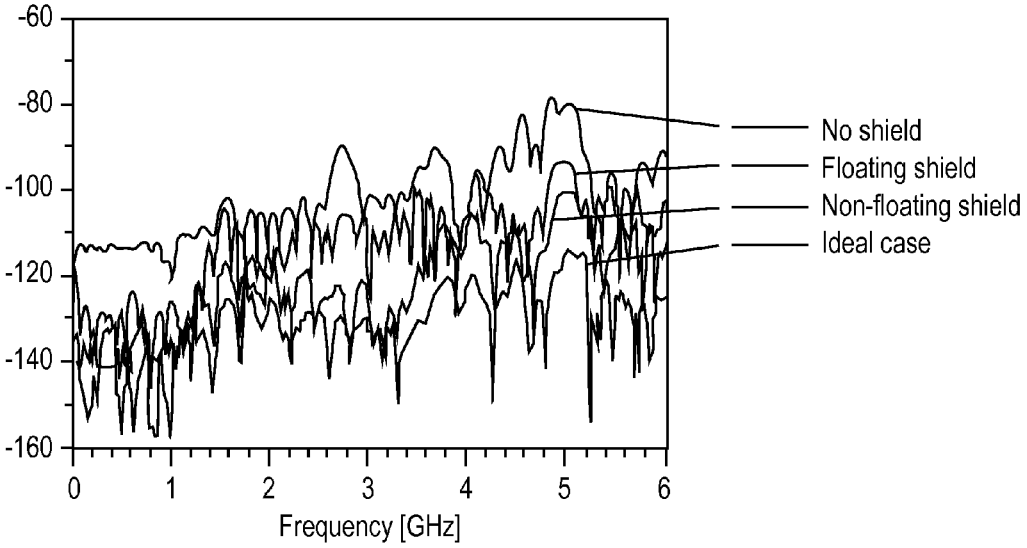
FIG. 17 is a graph illustrating a computer simulation of EMI.

FIG. 17 present computer simulations of the efficacy of embodiments set forth herein in the context of noise arising from an FFC as received at a Wi-Fi (Wireless Fidelity, e.g., Institute of Electrical and Electronics Engineers/IEEE 802.11-2007, Wireless Local Area Network/LAN Medium Access Control (MAC) and Physical Layer (PHY) Specifications) antenna that has been placed 5 cm away from a 6-inch long FFC cable. Considered was noise generated in the Giga-Hertz range. Four cases are simulated here:

1. FFC cable without shield;
2. FFC cable with floating single-layer shield;
3. FFC cable having a shield that is connected to a PCB ground through ground pins such as are set forth herein; and
4. Ideal case of a FFC cable having a shield that is provided with a theoretically perfect connection to a PCB ground.

The results of the simulation presented in FIG. 17 show that the noise coupled to the Wi-Fi antennae is much lower in case 3 than in cases 1 and 2, and is only a few dB higher than the ideal case.

The embodiments described above may be used in any electrical equipment employing FFC connectors, such as a computer, a personal computer (PC), laptop computer, ultra-laptop computer, tablet, touch pad, portable computer, hand-held computer, palmtop computer, personal digital assistant (PDA), cellular telephone, combination cellular telephone/PDA, television, smart device (e.g., smart phone, smart tablet or smart television), mobile internet device (MID), messaging device, data communication device, radio receiver, radio transmitter, video system, analog circuitry, digital circuitry and so forth.

ADDITIONAL NOTES AND EXAMPLES

Example 1 may include a connector, the connector comprising a plurality of electrically conductive signal pins, a plurality of electrically conductive ground pins having a first ground contact to provide a first ground connection to a circuit board and second and third ground contacts to provide a second ground connection to a cable, and a housing to contain the signal pins and the ground pins.

Example 2 may include the connector of Example 1, wherein the first ground connection is to be to a circuit board and the second ground connection is to be to a cable.

Example 3 may include the connector of Example 1, wherein the first and second ground contacts face one another.

Example 4 may include the connector of Example 1, further comprising a lever connected to the housing to provide pressure on the pins to thereby secure their electrical connection to the cable.

Example 5 may include the connector of Examples 1-4, wherein the second and third ground contacts are provided on spaced apart first and second arms.

Example 6 may include the connector of Example 5, wherein the first and second arms are spaced apart from one another such that they can grip a flat cable there between through contact with a conductive shield on the cable and with a ground line trace on the cable.

Example 7 may include the connector of Example 1, wherein the signal pins and ground pins are arranged in a ground pin, signal pin, signal pin, ground pin pattern.

Example 8 may include the connector of Example 1, wherein the connector is a back latch connector.

Example 9 may include the connector of Example 1, wherein the connector is a front latch connector.

Example 10 may include the connector of Example 1, wherein the connector is a side front latch connector.

Example 11 may include the connector of Example 5, wherein at least one arm has two contact points to provide two ground contacts to a cable.

Example 12 may include the connector of Examples 1-4 or 7-10, wherein the signal pins do not provide a ground connection to a cable.

Example 13 may include the connector of Example 11, wherein each arm has a contact point with which to establish an electrical contact with an electrically conductive shield on a cable.

Example 14 may include a method comprising establishing an electrical connection between a ground pin in a connector and a ground plane of a circuit; establishing an electrical connection between the ground pin and a ground line trace of a cable; establishing an electrical connection between the ground pin and a shield of the cable; and establishing an electrical connection between a signal pin in the connector and a signal line trace of the cable.

Example 15 may include the method of Example 14, wherein the shield is a flat conductive layer overlying most of the length of the cable.

Example 16 may include the method of Examples 14 or 15, including establishing an electrical connection with a second shield on the cable.

Example 17 may include the method of Example 16, wherein the first and second shields are parallel to one another.

Example 18 may include the method of Example 14, wherein the cable is a flat flexible cable.

Example 19 may include a system comprising a flat flexible cable having a plurality of signal traces, at least one ground trace, and a shield made of electrically conductive material overlying a substantial portion of the cable. The system further includes a connector to provide a ground connection to the cable, the connector comprising a plurality of signal pins, a plurality of ground pins having a first ground contact to provide a ground connection to a circuit board, a second ground contact to provide a ground connection to the shield, and a third ground contact to provide a ground contact to the ground trace. The system also includes a housing to contain the signal pins and the ground pins.

Example 20 may include the system of Example 19, wherein the first ground contact and the second ground contact are arranged on opposite ends of a first arm, and wherein the third ground contact is on a free end of a second arm that is spaced apart from the first arm.

Example 21 may include the system of Example 20, wherein the first and second arms are spaced apart from one another such that they can grip the cable there between.

Example 22 may include the system of Examples 19 or 20, wherein the signal pins and ground pins are arranged in a ground pin, signal pin, signal pin pattern.

Example 23 may include the system of Examples 19 or 20, wherein at least one arm has two contact points to provide two ground contacts to the cable.

Example 24 may include the system of Examples 19 or 20, wherein the signal pins do not provide a ground connection to a cable.

Example 25 may include the system of Examples 19 or 20, further comprising a Wi-Fi (Wireless Fidelity, e.g., Institute of Electrical and Electronics Engineers/IEEE 802.11-2007, Wireless Local Area Network/LAN Medium Access Control (MAC) and Physical Layer (PHY) Specifications) antenna or a wireless wide area network antenna.

Example 26 may include the system of Example 19, further comprising a printed circuit board having a ground plane.

Example 27 may include a connector comprising a plurality of signal pins; a plurality of ground pins having a first means to provide a ground connection to a circuit board and second and third means to provide a ground connection to a cable; and a housing to contain the signal pins and the ground pins.

Example 28 may include the connector of Example 27, wherein the first and second means face one another.

Example 29 may include the connector of Example 26, further comprising means to secure the pins within the housing.

Example 30 may include the connector of Examples 27-29, further including means for gripping a free end of a flat cable.

Example 31 may include a connector comprising means for establishing an electrical connection between a ground pin in a connector and a ground plane of a circuit; means for establishing an electrical connection between the ground pin and a ground line trace of a cable; means for establishing an electrical connection between the ground pin and a shield of a cable; and means for establishing an electrical connection between a signal pin in the connector and a signal line trace of a cable.

Example 32 may include the connector of Example 31, wherein the shield is a flat conductive layer overlying most of the length of the cable.

Example 33 may include the connector of Example 31, further comprising means to establish an electrical connection between the ground pin and a second shield of a cable.

Example 34 may include the connector of Example 31, further including means for securing a flat cable to the connector.

Example 35 may include a method to provide shielding against electromagnetic interference to a flat, flexible cable, comprising establishing an electrical connection between a ground pin in a connector and a ground plane of a circuit; establishing an electrical connection between the ground pin and a ground line trace of a cable; establishing an electrical connection between the ground pin and a first electrically conductive shield located on the cable; and establishing an electrical connection between a signal pin in the connector and a signal line trace of the cable.

Example 36 may include the method of Example 35, wherein the shielding protects electrical equipment from interference arising from the cable.

Example 37 may include the method of Examples 35 or 36, wherein the shielding protects the flat flexible cable from interference arising from outside the cable.

Example 38 may include the method of Examples 35 or 36, further comprising establishing an electrical connection between the ground pin and a second electrically conductive shield located on the cable.

Example 39 may include the method of Example 35, wherein the shielding protects an antenna against electromagnetic interference arising from the cable.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A connector to provide shielding to a flat, flexible cable, the connector comprising:

a plurality of electrically conductive signal pins;

a plurality of electrically conductive ground pins, each ground pin having a first ground contact to provide a first ground connection to a circuit board, and second, third, and fourth ground contacts located on spaced apart arms to provide respective second, third, and fourth ground connections to a cable, wherein two of the ground contacts are on one of the spaced apart arms; and a housing to contain the signal pins and the ground pins.

2. The connector of claim 1, wherein the first ground connection is to be to a circuit board and the second ground connection is to be to a cable.

3. The connector of claim 1, wherein the second and third ground contacts face one another.

4. The connector of claim 1, further comprising a lever connected to the housing to provide pressure on the pins to thereby secure their electrical connection to the cable.

5. The connector of claim 1, wherein the spaced apart arms are spaced apart from one another such that they can grip a flat cable therebetween through contact with a conductive shield on the cable and with a ground line trace on the cable.

6. The connector of claim 1, wherein the signal pins and ground pins are arranged in a ground pin, signal pin, signal pin, ground pin pattern.

7. The connector of claim 1, wherein the connector is a back latch connector.

8. The connector of claim 1, wherein the connector is a front latch connector.

9. The connector of claim 1, wherein the connector is a side front latch connector.

10. The connector of claim 1, wherein the signal pins do not provide a ground connection to a cable.

11. The connector of claim 1, wherein each arm has a contact point with which to establish an electrical contact with an electrically conductive shield on a cable.

12. A system for shielding against unwanted electromagnetic interference, comprising:

a flat flexible cable having a plurality of signal traces, at least one ground trace, and a shield made of electrically conductive material overlying a substantial portion of the cable; and a connector to provide a ground connection to the cable, the connector comprising a plurality of signal pins;

a plurality of ground pins having a first ground contact to provide a ground connection to a circuit board, a second ground contact to provide a ground connection to the shield, and a third ground contact to provide a ground contact to the ground trace; and a housing to contain the signal pins and the ground pins.

13. The system of claim 12, wherein the signal pins and ground pins are arranged in a ground pin, signal pin, signal pin pattern.

14. The system of claim 12, wherein at least one arm has two contact points to provide two ground contacts to the cable.

15. The system of claim 12, wherein the signal pins do not provide a ground connection to the cable.

16. The system of claim 12, further comprising a Wi-Fi antenna or a wireless wide area network antenna.

17. The system of claim 12, further comprising a printed circuit board having a ground plane.

18. The system of claim 12, wherein the first ground contact and the second ground contact are arranged on opposite ends of a first arm, and wherein the third ground contact is on a free end of a second arm that is spaced apart from the first arm.

19. The system of claim 18, wherein the first and second arms are spaced apart from one another such that they may grip the cable there between.

* * * * *